US006348016B2

(12) United States Patent
Nakamura

(10) Patent No.: US 6,348,016 B2
(45) **Date of Patent: *Feb. 19, 2002**

(54) SOLID GOLF BALLS

(75) Inventor: Atsushi Nakamura, Chichibu (JP)

(73) Assignee: Bridgestone Sports Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/332,035

(22) Filed: Jun. 14, 1999

(30) Foreign Application Priority Data

Jun. 18, 1998 (JP) ..... 10-171298

(51) Int. Cl.[7] ..... A63B 37/04; A63B 37/06

(52) U.S. Cl. ..... 473/371; 473/372; 473/373; 473/354; 473/363; 473/365; 473/377; 473/384; 473/385

(58) Field of Search ..... 473/371, 372, 473/373, 354, 363, 365, 377, 384, 385

(56) References Cited

U.S. PATENT DOCUMENTS

| | | | | | |
|---|---|---|---|---|---|
| 4,229,504 | A | * | 10/1980 | Branchman | 428/461 |
| 5,019,319 | A | * | 5/1991 | Nakamura et al. | 473/373 |
| 5,702,311 | A | * | 12/1997 | Higuchi et al. | 473/373 |
| 5,752,889 | A | * | 5/1998 | Yamagishi | 473/377 |
| 5,776,012 | A | * | 7/1998 | Moriyama et al. | 473/372 |
| 5,782,702 | A | * | 7/1998 | Yamagishi | 473/280 |
| 5,807,192 | A | | 9/1998 | Yamagishi et al. | 473/377 |
| 5,820,492 | A | * | 10/1998 | Yamagishi et al. | 473/377 |
| 5,833,553 | A | * | 10/1998 | Sullivan et al. | 473/374 |
| 5,863,264 | A | * | 1/1999 | Yamagishi | 473/377 |
| 5,962,140 | A | * | 10/1999 | Rajagopalan | 428/421 |
| 5,971,872 | A | * | 10/1999 | Sullivan | 473/377 |
| 6,015,356 | A | * | 1/2000 | Sullivan | 473/373 |
| 6,056,650 | A | * | 5/2000 | Yamagishi | 473/374 |
| 6,083,119 | A | * | 7/2000 | Sullivan | 473/354 |

FOREIGN PATENT DOCUMENTS

| | | |
|---|---|---|
| JP | 57-25867 | 2/1982 |
| JP | 60-210272 | 10/1985 |
| JP | 5-073427 | 10/1993 |
| JP | 6-277312 | 10/1994 |
| JP | 9-108383 | 4/1997 |

* cited by examiner

*Primary Examiner*—Lee Young
*Assistant Examiner*—Paul D. Kim
(74) *Attorney, Agent, or Firm*—Sughrue Mion, PLLC

(57) ABSTRACT

A solid golf ball has a soft solid core and a hard cover. The cover is formed of a thermoplastic resin-base cover stock, with 11–45 parts by weight of a particulate inorganic filler added thereto per 100 parts by weight of the cover stock. The solid core undergoes a deflection of 3.0 to 5.5 mm under a load of 100 kg. The ball is drastically improved in durability against cracking.

7 Claims, No Drawings

SOLID GOLF BALLS

This invention relates to a solid golf ball and more particularly, to a solid golf ball comprising a solid core and a cover wherein a cover stock is loaded with an inorganic filler for improving the durability against cracking of the cover.

BACKGROUND OF THE INVENTION

In the prior art, attempts were made to soften golf balls for the purpose of improving the resilience and "feel" of golf balls. One common approach involves softening the core from the standpoint of feel and enclosing the soft core within a hard cover to compensate for resilience. This approach is successful in improving resilience, but leaves the problem that the cover can be cracked upon repetitive shots.

The addition of inorganic fillers to cover stock is known from a number of patents, for example, JP-B 5-73427, JP-A 57-25867, JP-A 60-210272, and JP-A 6-277312. The addition of inorganic fillers is to increase the specific gravity of the cover for increasing the moment of inertia of the ball for improving the flight performance thereof. Excess loading of inorganic filler can however compromise the resilience and cracking durability of the ball.

SUMMARY OF THE INVENTION

An object of the invention is to provide a novel and improved solid golf ball in which an appropriate amount of an inorganic filler is added to a cover stock as a reinforcement so that the cover is drastically improved in durability against cracking by repetitive shots.

The inventor has found that when an appropriate amount of an inorganic filler having an optimum specific gravity is added to a cover stock, the inorganic filler advantageously functions as a reinforcement for improving durability against cracking. As a result, a golf ball comprising a soft core and a hard cover in a combination which has never been established heretofore is obtained.

The invention provides a solid golf ball comprising a solid core and a cover enclosing the core. The solid core undergoes a deflection of 3.0 to 5.5 mm under a load of 100 kg. The cover is formed of a thermoplastic resin-base cover stock in which a particulate inorganic filler, preferably having a specific gravity of up to 4.8, is uniformly dispersed in an amount of at least 11 parts by weight, preferably 11 to 45 parts by weight, per 100 parts by weight of the cover stock. Quite unexpectedly, this inorganic filler exerts the excellent reinforcing effect of restraining the cover from cracking by repetitive shots. There is obtained a softened golf ball based on a soft core/hard cover combination which has never been established heretofore and having improved resilience and a pleasant feel.

It is understood that although the invention adds an inorganic filler to a cover stock, the invention does not intend to increase the specific gravity of the cover for increasing the moment of inertia of the ball for improving the flight performance thereof. Rather, by dispersing in a cover stock an appropriate amount of an inorganic filler having a certain mean particle size and specific gravity, the invention intends to cause the inorganic filler to function as a reinforcement for improving the durability against cracking of the cover, thereby achieving a softened golf ball based on a soft core/hard cover combination which has never been established heretofore.

DESCRIPTION OF THE PREFERRED EMBODIMENTS

Briefly stated, the golf ball of the invention is comprised of a solid core and a cover enclosing the core.

The solid core is formed of a rubber composition primarily comprising a base rubber containing polybutadiene rubber, polyisoprene rubber, natural rubber or silicone rubber as a main component. For high resilience, polybutadiene rubber is preferable. The polybutadiene rubber used herein is preferably 1,4-cis-polybutadiene containing at least 40% of cis structure. In the base rubber, another rubber component such as natural rubber, polyisoprene rubber or styrene-butadiene rubber may be blended with the polybutadiene if desired. Since increasing the proportion of polybutadiene rubber is effective for improving the resilience of balls, the other rubber component should preferably be less than about 10 parts by weight per 100 parts by weight of polybutadiene.

In the rubber composition, a crosslinking agent may be blended with the rubber component. Exemplary crosslinking agents are zinc and magnesium salts of unsaturated fatty acids such as zinc methacrylate and zinc acrylate, and esters such as trimethylpropane methacrylate. Of these, zinc acrylate is preferred because it can impart high resilience. The crosslinking agent is preferably used in an amount of about 15 to 40 parts by weight per 100 parts by weight of the base rubber. A vulcanizing agent such as dicumyl peroxide may also be blended, preferably in an amount of about 0.1 to 5 parts by weight per 100 parts by weight of the base rubber. In the rubber composition, zinc oxide or barium sulfate may be blended as an antioxidant or specific gravity adjusting filler. The amount of filler blended is preferably 0 to about 130 parts by weight per 100 parts by weight of the base rubber.

One preferred formulation of the solid core-forming rubber composition is given below.

| | Parts by weight |
|---|---|
| Cis-1, 4-polybutadiene | 100 |
| Zinc oxide | 5 to 40 |
| Zinc acrylate | 15 to 40 |
| Barium sulfate | 0 to 40 |
| Peroxide | 0.1 to 5.0 |

Vulcanizing conditions include a temperature of 150±10° C. and a time of about 5 to 20 minutes.

The rubber composition is obtained by kneading the above-mentioned components in a conventional mixer such as a kneader, Banbury mixer or roll mill. The resulting compound is molded in a mold by injection or compression molding.

The solid core is preferably made to a diameter of 33 to 42 mm, more preferably 37 to 40 mm and a weight of 30.0 to 38.0 grams, more preferably 32.0 to 37.0 grams.

The solid core undergoes a deflection under a load of 100 kg of 3.0 to 5.5 mm, preferably 3.5 to 5.0 mm, more preferably 4.0 to 5.0 mm. A core with a deflection of less than 3.0 mm is too hard, failing to achieve the object of core softening. A core with a deflection of more than 5.5 mm is too soft, resulting in a substantial loss of resilience.

The core may be formed to either a single layer structure from one material or a multilayer structure of two or more layers of different materials.

The cover is preferably made of a cover stock based on a thermoplastic resin and having a relatively high hardness. The cover base may be selected from polyester elastomers, ionomer resins, styrene elastomers, urethane resins, and hydrogenated butadiene rubbers and mixtures thereof, for example, with the ionomer resins being especially preferred. Use may be made of commercially available ionomer resins such as Surlyn (E. I. Dupont) and Himilan (Mitsui Dupont Polychemical K.K.).

According to the invention, an appropriate amount of an inorganic filler is added to the thermoplastic resin-base cover stock as a reinforcement. The inorganic filler is particulate and preferably has a mean particle size of 0.01 to 100 $\mu$m, more preferably 0.1 to 10 $\mu$m, most preferably 0.1 to 1.0 $\mu$m. Outside the range, that is, too small or too large filler particles would be less dispersible, failing to achieve the objects of the invention.

The inorganic filler should preferably have a specific gravity of 4.8 or lower, more preferably from 1.0 to 4.5. The use of a filler having a specific gravity of more than 4.8 would excessively increase the weight of cover stock to such an extent that the cover stock might not be practically applicable to golf balls whose overall weight is prescribed by the Rules of Golf. On the other hand, a filler with a specific gravity of less than 1.0 would reduce the specific gravity of the cover stock and not effectively exert its own function when blended.

Examples of the inorganic filler fulfilling the above-described ranges of mean particle size and specific gravity include barium sulfate (specific gravity about 4.47), titanium dioxide (specific gravity about 4.17), and calcium carbonate (specific gravity about 2.6). These fillers may be used alone or in admixture of two or more.

The inorganic filler is added to the cover stock in an amount of at least 11 parts, preferably 11 to 45 parts, more preferably 15 to 40 parts by weight, per 100 parts by weight of the cover stock. On this basis, less than 11 parts of the filler fails to provide reinforcement whereas more than 45 parts of the filler would adversely affect dispersion and resilience.

In the cover stock, other ingredients including UV absorbers, antioxidants, and dispersants such as metal soaps are added if desired.

The cover is formed around the core by any desired method, for example, conventional injection and compression molding methods. The cover may be formed to either a single layer structure from one material or a multilayer structure of two or more layers of different materials.

The thus molded cover should preferably have a specific gravity of at least 0.97, more preferably 1.05 to 1.5, most preferably 1.16 to 1.3. If a cover has a specific gravity of less than 0.97, the solid core must be heavier than in the prior art, which would be sometimes disadvantageous from the resilience standpoint.

Preferably, the cover has a gage (or radial thickness) of 0.5 to 4.0 mm, more preferably 1.0 to 3.0 mm and a Shore D hardness of 45 to 70, more preferably 55 to 70. At a Shore D hardness of less than 45, the cover would be excessively soft and aggravate the resilience of balls, and the original cover stock must be highly durable, which is incompatible with the need to add a filler for durability improvement. At a Shore D hardness of more than 70, the original cover stock must have very low durability, with which the reinforcing effect of the filler would not become evident.

The golf ball, thus obtained, comprising the soft core combined with the hard cover offers a soft pleasant feel and high resilience and is dramatically improved in durability against repetitive shots.

The golf ball of the invention has a multiplicity of dimples in its surface. The ball on its surface is subject to finishing treatments such as painting and stamping, if necessary. The golf ball as a whole preferably has a hardness corresponding to a deflection of 2.6 to 5.0 mm, more preferably 2.8 to 4.5 mm, under a load of 100 kg. The golf ball must have a diameter of not less than 42.67 mm and a weight of not greater than 45.93 grams in accordance with the Rules of Golf.

There has been described the golf ball in which the inorganic filler added to the cover stock functions as a reinforcement. By virtue of this reinforcement, the golf ball based on the soft core/hard cover combination which has never been achieved heretofore is fully durable against cracking and presents a soft feel when hit.

EXAMPLE

Examples of the invention are given below by way of illustration and not by way of limitation. All parts are by weight.

Examples 1–4 & Comparative Examples 1–3

Solid cores were prepared by working rubber compositions of the formulation shown in Tables 1 and 2 in a kneader, and molding and vulcanizing them in molds at a temperature of 155° C. for about 15 minutes.

Cover stocks of the formulation shown in Tables 1 and 2 were injection molded around the cores, obtaining solid golf balls of Examples 1–4 and Comparative Examples 1–3 having a diameter of 42.7 mm and a weight of 45.2 grams.

The golf balls were determined for hardness, durability index, and initial velocity by the following tests while the cores were determined for hardness. The results are also shown in Tables 1 and 2.

Core Hardness a deflection (mm) of the core under an applied load of 100 kg

Ball Hardness a deflection (mm) of the ball under an applied load of 100 kg

Durability Index

Using a swing robot, the ball was repetitively hit with a driver (J's World Stage, loft angle 11 degrees, Bridgestone Sports Co., Ltd.) at a head speed of 45 m/sec. The number of hits was counted until the cover cracked and is expressed in a relative index based on an index of 100 for the ball of Comparative Example 1.

Initial Velocity

Using a swing robot, the ball was repetitively hit with a driver (J's World Stage, loft angle 11 degrees, Bridgestone Sports Co., Ltd.) at a head speed of 45 m/sec. The initial velocity was measured on apparatus approved by the R&A.

TABLE 1

| | | Example | | | |
|---|---|---|---|---|---|
| | | 1 | 2 | 3 | 4 |
| Solid core | Cis-1, 4-polybutadiene | 100 | 100 | 100 | 100 |
| | Zinc acrylate | 24.0 | 24.5 | 27.0 | 27.5 |
| | Zinc oxide | 18.0 | 12.0 | 17.0 | 11.0 |
| | Dicumyl peroxide | 0.9 | 0.9 | 0.9 | 0.9 |
| | Diameter (mm) | 38.7 | 38.7 | 38.1 | 39.1 |
| | Weight (g) | 33.5 | 33.0 | 33.5 | 33.0 |
| | Hardness (mm) | 4.5 | 4.5 | 4.0 | 4.0 |

TABLE 1-continued

| | | Example | | | |
|---|---|---|---|---|---|
| | | 1 | 2 | 3 | 4 |
| Cover | Himilan 1605 | - | - | - | 50 |
| | Himilan 1601 | 50 | 50 | 50 | - |
| | Himilan 1557 | 50 | 50 | 50 | 50 |
| | $BaSO_4$ | 20 | 30 | - | - |
| | $TiO_2$ | - | - | 20 | 30 |
| | Shore D hardness | 60 | 61 | 60 | 62 |
| | Gage (mm) | 2.0 | 2.0 | 2.3 | 1.8 |
| | Specific gravity | 1.115 | 1.183 | 1.113 | 1.179 |
| Ball | Durability index | 136 | 176 | 148 | 195 |
| | Hardness (mm) | 3.6 | 3.5 | 3.3 | 3.2 |
| | Initial velocity (m/sec) | 66.0 | 66.0 | 66.1 | 66.1 |

TABLE 2

| | | Comparative Example | | |
|---|---|---|---|---|
| | | 1 | 2 | 3 |
| Solid core | Cis-1, 4-polybutadiene | 100 | 100 | 100 |
| | Zinc acrylate | 24.0 | 27.0 | 22.0 |
| | Zinc oxide | 24.0 | 1.0 | 19.0 |
| | Dicumyl peroxide | 0.9 | 0.9 | 0.9 |
| | Diameter (mm) | 38.7 | 38.7 | 39.1 |
| | Weight (g) | 35.0 | 31.7 | 34.5 |
| | Hardness (mm) | 4.5 | 4.5 | 6.0 |
| Cover | Himilan 1605 | - | - | 50 |
| | Himilan 1601 | 50 | 50 | - |
| | Himilan 1557 | 50 | 50 | 50 |
| | $BaSO_4$ | - | 50 | - |
| | $TiO_2$ | - | - | 30 |
| | Shore D hardness | 59 | 63 | 62 |
| | Gage (mm) | 2.0 | 2.0 | 1.8 |
| | Specific gravity | 0.97 | 1.311 | 1.179 |
| Ball | Durability index | 100 | 106 | 83 |
| | Hardness (mm) | 3.7 | 3.4 | 5.2 |
| | Initial velocity (m/sec) | 66.0 | 65.7 | 65.3 |

Note:

Himilan is the trade name of ionomer resin by Mitsui Dupont Polychemical K.K.

Barium sulfate ($BaSO_4$) used had a specific gravity of 4.47 and a mean particle size of 0.7 $\mu$m.

Titanium oxide ($TiO_2$) used had a specific gravity of 4.17 and a mean particle size of 0.3 $\mu$m.

As seen from Tables 1 and 2, the golf ball of Comparative Example 1 is less durable because no inorganic filler is added to the cover stock. The golf ball of Comparative Example 2 is not as durable because a larger amount of inorganic filler is added to the cover stock so that the filler cannot exert a full reinforcement effect. Although Comparative Example 3 uses the same cover stock and filler as Example 4, the golf ball of Comparative Example 3 shows an extremely poor durability and a low initial velocity because its core is too soft as compared with Example 4.

In contrast, the golf balls of Examples 1 to 4 having the structure of the soft core enclosed within the hard cover are dramatically improved in durability against repetitive shots and exhibit satisfactory resilience.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A solid golf ball comprising a solid core formed of rubber and a cover enclosing the core, wherein said cover is formed of a thermoplastic resin-base cover stock, with 11 to 45 parts by weight of a particulate inorganic filler having a specific gravity of up to 4.8 added thereto per 100 parts by weight of the cover stock and has a specific gravity in the range of 1.05 to 1.5, and a Shore D hardness in the range of 55 to 70, said inorganic filler is selected from barium sulfate and titanium dioxide and has a mean particle size of 0.1 to 10 $\mu$m, said solid core undergoes a deflection of 3.0 to 5.5 mm under a load of 100 kg and has a diameter in the range of 37 to 40 mm, and wherein said golf ball as a whole has a deflection of 2.6 to 5.0 mm under an applied load of 100 kg.

2. The golf ball of claim 1 wherein said inorganic filler has a specific gravity in the range of 1.0 to 4.5.

3. The golf ball of claim 1 wherein said cover has a specific gravity of at least 0.97.

4. The golf ball of claim 1 wherein said cover has gage in the range of 0.5 to 4.0 mm.

5. The golf ball of claim 1 wherein said cover has a specific gravity in the range of 1.05 to 1.183.

6. The golf ball of claim 1, wherein the cover is formed of a material selected from polyester elastomers, ionomer resins, styrene elastomers, urethane resins, and hydrogenated butadiene rubbers and mixtures thereof.

7. The golf ball claim 6, wherein the cover is formed of two or more layers of different materials.

* * * * *